US008104405B2

(12) United States Patent
LaFont et al.

(10) Patent No.: US 8,104,405 B2
(45) Date of Patent: Jan. 31, 2012

(54) AMMUNITION FIRING DEVICE INCORPORATING A FIRING PIN

(75) Inventors: Renaud LaFont, Bourges (FR); Pierre Magnan, Saint Palais (FR)

(73) Assignee: Nexter Munitions, Versailles (FR)

( * ) Notice: Subject to any disclaimer, the term of this patent is extended or adjusted under 35 U.S.C. 154(b) by 0 days.

(21) Appl. No.: 12/662,311

(22) Filed: Apr. 9, 2010

(65) Prior Publication Data

US 2010/0258021 A1 Oct. 14, 2010

(30) Foreign Application Priority Data

Apr. 10, 2009 (FR) ..... 09 01797

(51) Int. Cl.
*F42C 15/24* (2006.01)

(52) U.S. Cl. ..... 102/252; 102/204; 102/247; 102/251; 102/254; 102/272

(58) Field of Classification Search ..... 102/222, 102/231, 234, 236, 237, 239, 242, 247, 252, 102/256, 272, 274, 204, 251
See application file for complete search history.

(56) References Cited

U.S. PATENT DOCUMENTS 3,390,637 A 7/1968 Kent
3,958,511 A * 5/1976 Morrow et al. ..... 102/251
4,782,757 A * 11/1988 Carter ..... 102/394
5,003,881 A * 4/1991 Herold et al. ..... 102/337
6,321,654 B1 11/2001 Robinson

FOREIGN PATENT DOCUMENTS

EP 1 780 495 A1 5/2007
EP 1 780 496 A1 5/2007
FR 1 300 100 A 7/1962
FR 2 689 972 10/1993
GB 927023 A * 5/1963

OTHER PUBLICATIONS

French Search Report in French Patent Application No. 09.01797 dated Nov. 16, 2009 (with translation).

* cited by examiner

*Primary Examiner* — James Bergin
(74) *Attorney, Agent, or Firm* — Oliff & Berridge, PLC

(57) ABSTRACT

An ammunition firing device incorporating a firing pin intended to impact a pyrotechnic composition to activate its ignition, wherein said firing pin incorporates a rod that slides when said ammunition is fired through the effect of the firing acceleration from a starting position to a deployed position, able to be locked in said deployed position, said rod being integral with a percussion tip occupying a fixed position in contact with said pyrotechnic composition, said rod being located fully inside said tip in said starting position and protruding from said tip in its deployed position, said device further incorporating a hammer to strike said rod during the impact of said ammunition on a target to cause the ignition of said composition.

12 Claims, 7 Drawing Sheets

AMMUNITION FIRING DEVICE INCORPORATING A FIRING PIN

BACKGROUND OF THE INVENTION

1. Field of the Invention

The technical scope of the invention is that of ammunition firing devices using a mechanical firing pin that impacts a pyrotechnic composition.

2. Description of the Related Art

Classically, firing devices incorporate a firing pin projected via inertia onto the pyrotechnic composition after a certain number of safety barriers have been raised. This firing pin is also very often projected by a spring, so as to ensure a self-destruct function (when, for example, there is no impact on a target).

Patent FR-2689972 thus discloses a firing device for a medium caliber projectile (caliber of between 20 mm and 50 mm). This device comprises a firing pin that can be pushed towards a primer by means of a spring.

So as to avoid any risk of inadvertent percussion during the storage or transport phases, the primer is integral with an arming rotor that enables it to be kept at a distance from the firing pin before firing.

Such architecture is, however, complicated and necessitates the manufacture of many mechanical parts incorporating precise machining.

Classically, the self-destruct spring is kept tensed during the storage and transport phases. Even if this spring is compressed slightly more during firing more often than not to enable the locks of the primer rotor to be removed, sufficient energy for self-destruction requires the storage of the spring in a tensed state.

The aim of the invention is to simplify such a device by proposing an architecture in which the percussive primer is still aligned with the firing pin but the shocks to which it is subjected during the storage and transport phases are not able to cause the percussion of the primer.

With the device according to the invention, only those stresses linked to firing can make the device able to be primed.

The invention also enables a self-destruct mechanism to be implemented in which the spring means do not need to be compressed during assembly.

Thus, thanks to the invention, the springs are not stored in their tensed state thereby ensuring the maintenance of the device's performances despite long storage phases and with substantial temperature ranges.

An ammunition firing device is also known by patent FR-1300100 that incorporates a firing pin integral with a percussion body that is locked in the safety position by balls.

This device thus incorporates a firing pin that is permanently aligned with the primer but which is locked by safety means that are removed for firing.

These safety means comprise two counterweights sliding through inertia, the first counterweight releasing the balls locking the firing pin.

This device is complicated in structure. It is, indeed, necessary for the two counterweights to slide in a predefined order for the firing pin to be released. Indeed, the balls are pushed by one of the counterweights against the second counterweight. It is thus necessary for the latter to be rapidly distance during firing to avoid the balls becoming blocked.

It is furthermore necessary for the second counterweight to remain locked (at least temporarily) to enable the locking balls to be ejected from the firing pin. This locking is ensured by other balls housed in a groove in the second counterweight, groove whose bottom is conical. These locking balls are thus moved away during firing by means of their axial inertia and thereafter engage against a ramp of the firing pin.

This solution, which is particularly costly with regard to machining and assembly, means that the spin rate of the projectile is no longer a factor. It is, however, not very reliable, the balls only remaining in the locking position because of the single action of the counterweight return spring.

Practically, upon impact on the target, it is classically the sole inertia of the firing pin (including that of the second counterweight) acting against the effect of a return spring, which ensures the ignition of the primer.

As all known solutions thus implement the inertia of a firing pin, the energy available on impact on a target is proportional to the mass of the firing pin and the distance over which the latter has travelled to ignite the primer. This energy E is equal to $m\gamma D$, expression in which m is the mass of the firing pin, D its travel distance and $\gamma$ the deceleration upon impact on a target.

Classically, geometries in which the firing pins are sliding rods that are not driven by springs, lead to relatively substantial strokes (of around ten millimeters).

The aim of the invention is to propose a device of simple design in which only those stresses linked to firing are able to make the device able to be primed, and furthermore in which the percussion function is completely disassociated from the energy supply function for percussion.

This enables the design of more compact percussion firing devices since it is no longer necessary for a substantial stroke to be provided for the firing pin.

The invention is more particularly applicable in the field of fuses and firing devices incorporating micro-machined or micro-engraved elements (MEMS—Micro Electro Mechanical System—technology).

For the past few years, all or part of safety devices for ammunition have been proposed to be manufactured using chips incorporating micro machined or micro engraved electro mechanical elements, either in an element deposited on a substrate or directly on the substrate itself. This technology known under the name of MEMS (Micro Electro Mechanical System) enables micro-mechanisms to be made by implementing a technique close to that used to make integrated electronic circuits.

Safety and arming devices are known, namely by patents EP1780495 and EP1780496, that implement a shutter to break the micro-machined or micro-engraved pyrotechnic train.

However, to date no firing device for ammunition is known with a mechanical firing pin that implements MEMS technology.

One of the reasons explaining this absence of solution is the impossibility of producing tensed-state springs using MEMS technology. It is thus necessary for these springs to be compressed in a storage position with all the ensuing difficulties of conducting such an operation with a device or very reduced dimensions (a MEMS chip generally has dimensions of less than or equal to 10 mm).

SUMMARY OF THE INVENTION

The device according to the invention is easily transposable to the manufacture of a device of very reduced dimensions and in particular to a device made using MEMS technology.

The invention thus relates to an ammunition firing device, incorporating a firing pin intended to impact a pyrotechnic composition to activate its ignition, device wherein the firing pin incorporates a rod that slides when the ammunition is fired through the effect of the firing acceleration from a starting position to a deployed position, able to be locked in the deployed position, such rod being integral with a percussion tip occupying a fixed position in contact with the pyrotechnic composition, such rod being located fully inside the tip in the starting position and protruding from the tip in its deployed position, device further incorporating a hammer to strike the rod during the impact of the ammunition on a target to cause the ignition of the composition.

The sliding rod may be locked in its deployed position by at least one centrifugal lock.

The sliding rod will be advantageously linked to the tip by a tensile spring.

The percussion tip may be integral with a partition that will delimit a cavity receiving the pyrotechnic compositions, embrittlement means being provided to separate the tip from the partition during the impact of the hammer.

According to one embodiment, the hammer may be projected against the extendable rod by spring means.

The hammer may be found in the starting position in the vicinity, of the undeployed rod before firing, the spring means being in their uncompressed state and the firing acceleration will cause the displacement of the hammer and the compression of the spring means.

The hammer may be held away from the firing pin by retention means comprising at least one centrifugal counterweight cooperating with a fixed ramp.

According to a particular embodiment, the whole device may be made in the form of plane elements micro-machined or micro-engraved onto a wafer.

The device may incorporate a bushing enabling the pyrotechnic composition to be put into place on top of the tip.

BRIEF DESCRIPTION OF THE DRAWINGS

The invention will become more apparent from the following embodiments, such description being made with reference to the appended drawings, in which.

DETAILED DESCRIPTION OF PREFERRED EMBODIMENTS

Figure 1:
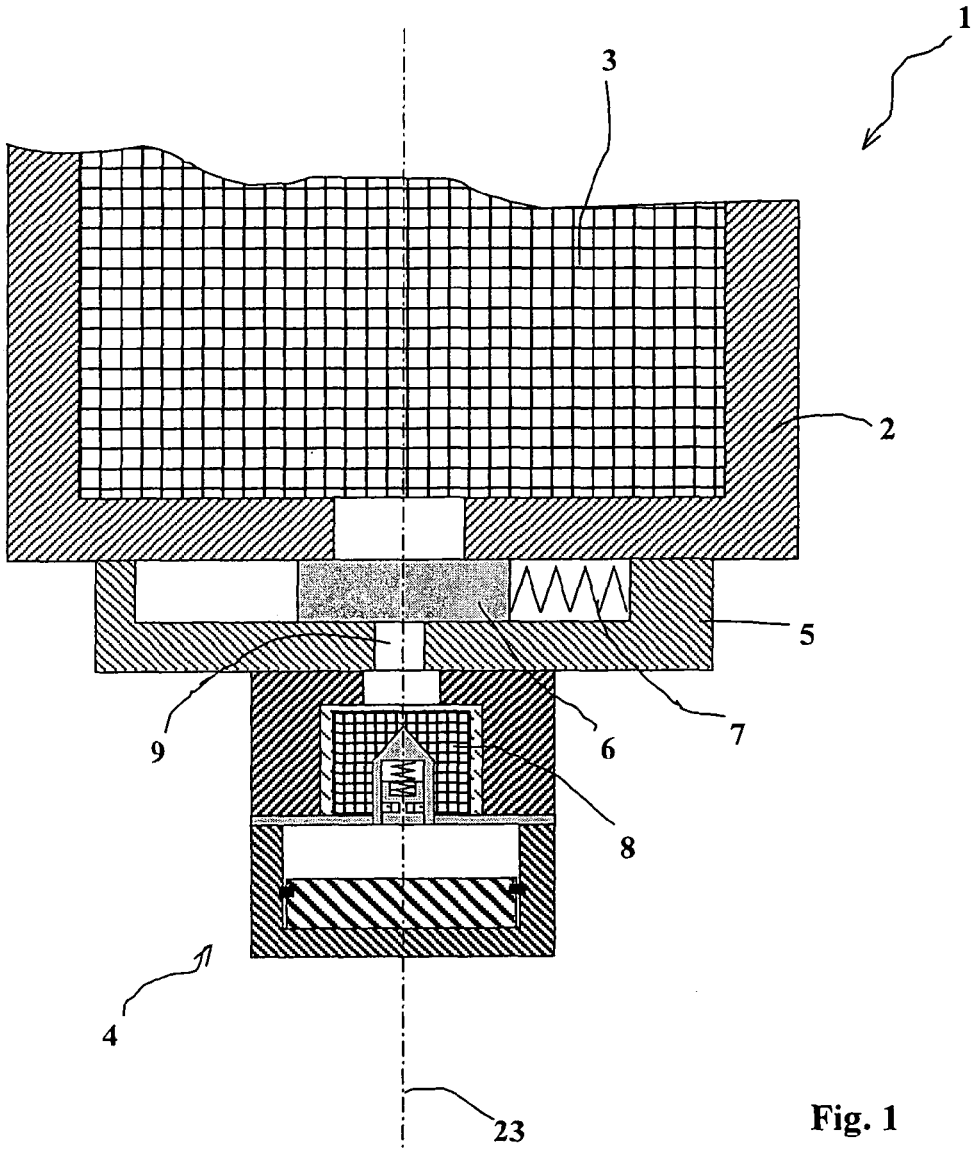
FIG. 1 shows the general configuration of a piece of ammunition incorporating a device according to the invention.

FIG. 1 schematically shows a section view of a body 2 of a piece of ammunition 1 that encloses an explosive load 3. This explosive is ignited by a firing device 4 and a safety and arming device 5 is positioned between the firing device and the explosive load 3.

The safety and arming device 5 is shown here very schematically. It essentially incorporates a shutter 6 which enables the transmission channel 9 to be broken between a pyrotechnic composition 8 (integral with a firing device 4) and the explosive load 3.

The shutter 6 is mobile in translation through the action of motor means that are shown here schematically by a spring 7. Classically, locking means (not shown) will release the shutter 6 further to the detection of different events associated with firing the ammunition (for example, inertial locks).

This safety device does not form part of the present invention and thus does not require a more detailed description. The safety and arming device 5, the firing device 4 and the body 2 of the ammunition are linked to one another by means not shown, for example threaded rings.

Figure 2A:
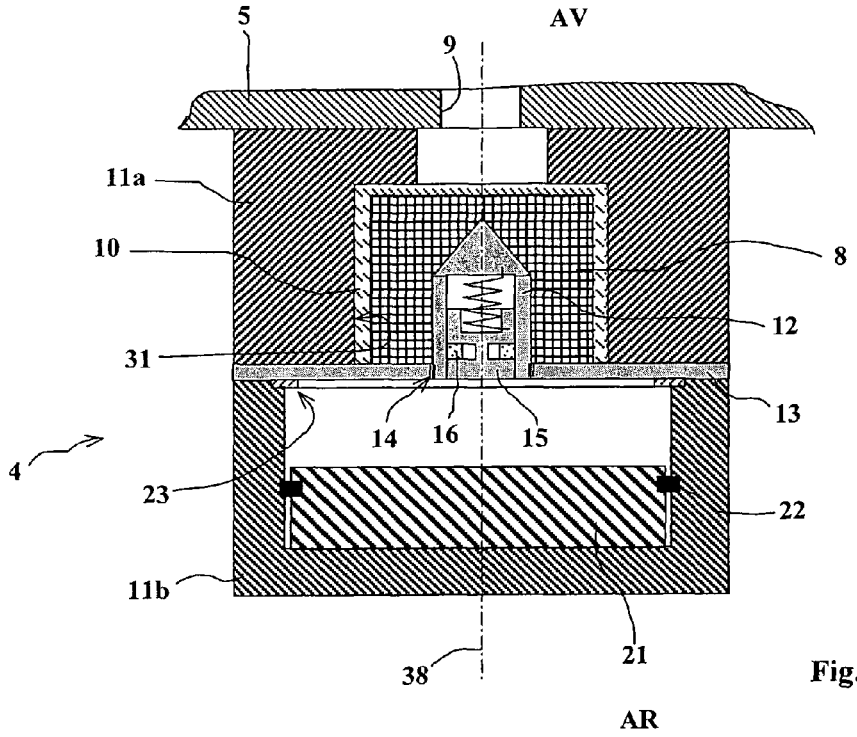
FIGS. 2*a*, 2*b* and 2*c* are schematic section views of a first embodiment of the device according to the invention, FIG. 2*a* showing the device in its storage position, FIG. 2*b* in its armed position after firing and FIG. 2*c* in its percussion position.
Figure 2B:
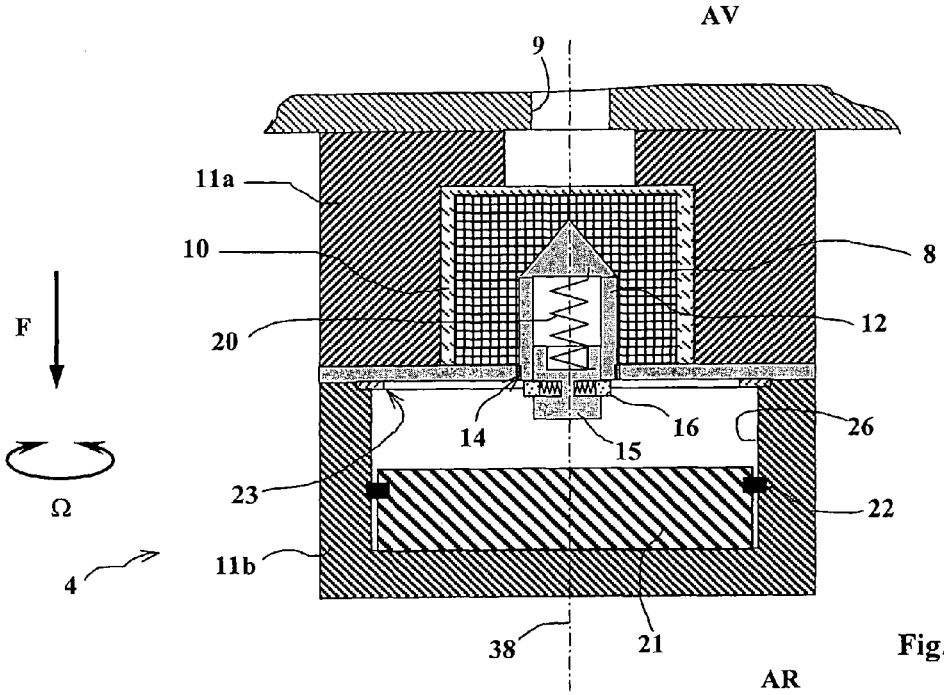
Figure 2C:
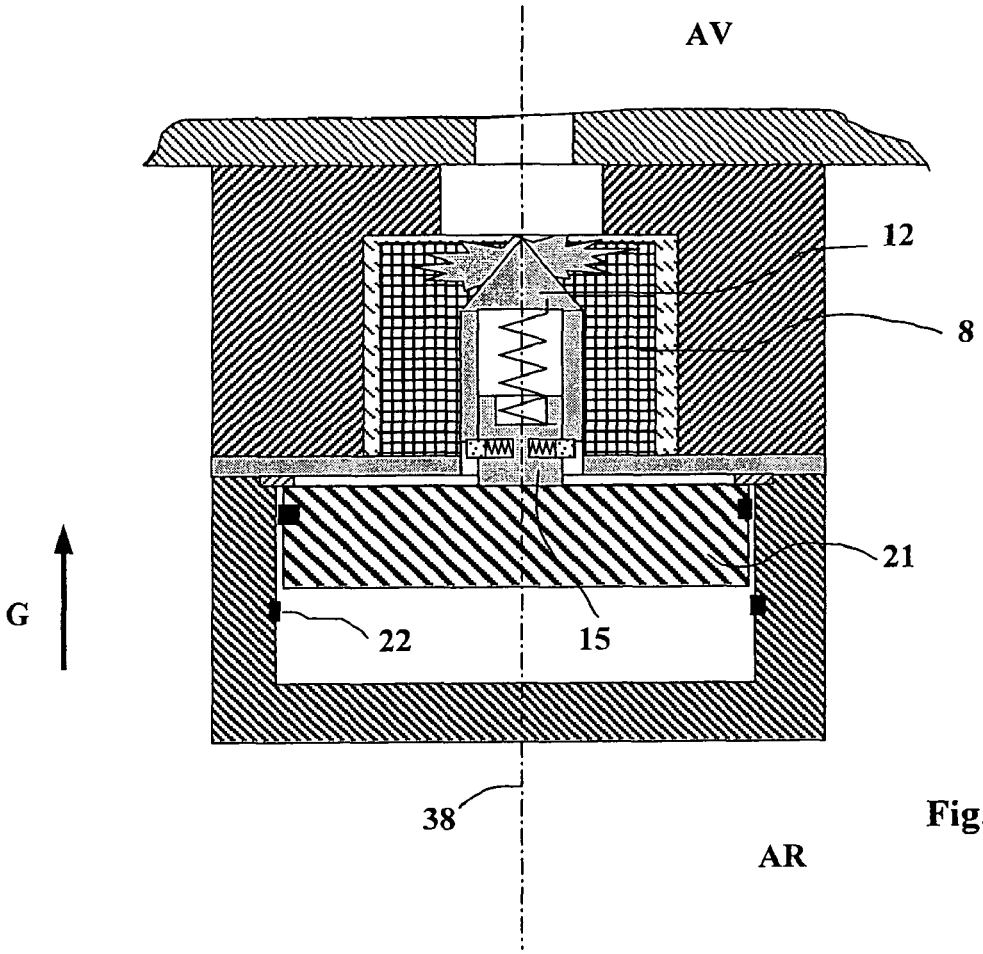

FIGS. 2*a* to 2*c* show a first embodiment of a firing device according to the invention.

This device incorporates a percussion-sensitive pyrotechnic composition 8 arranged in a cup 10 positioned in a cavity 31 of a front part 11*a* of a body of the device 4. A percussion tip 12 is fixed in the cup 10 and is in contact with the pyrotechnic composition 8. This tip is integral with a partition 13 that is positioned between the rear part 11*b* and front part 11*a* of the device's body. The partition 13 also enables the cavity 31 and the cup 10 enclosing the composition 8 to be closed.

The front 11*a* and rear 11*b* parts of the body are linked to one another by means not shown, for example by a threaded ring. A washer 23 is positioned between these two parts.

The tip 12 is made integral with the partition 13 by shearable linking means 14, for example threading.

The tip 12 has an inner housing inside which a rod 15 is mounted sliding.

The rod 15 may slide between a retracted position (FIG. 2*a*) and a deployed position (FIG. 2*b*) through the effect of the acceleration force F linked to the firing of the ammunition.

The rod 15 can be locked in its deployed position by two centrifugal locks 16. These locks are cylindrical parts held in their retracted position (FIG. 2*a*) by the internal cylindrical surface of the bore hole in the tip 12. They slide under the effect of the spin acceleration developed during firing.

Figure 2D:
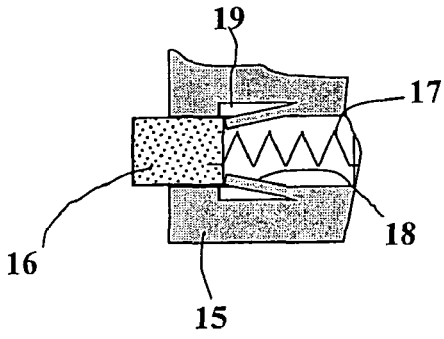
FIG. 2*d* is a detailed view showing the immobilization of a lock in the deployed position.

FIG. 2*d* shows a lock 16 in greater detail in its deployed position. This lock can be seen to be integral with the rod 15 by a tensile spring 17. Two flexible tabs 18 are held back in housings 19 when the lock 16 is in the retracted position. These tabs 18 unfold when the lock 16 is deployed and they ensure the retention of this lock in its deployed position. The effect of the spring 17 is to hold the lock 16 pressed against the tabs 18 and prevents any vibration or inadvertent unlocking when the spin acceleration is reduced.

The Figures show that a tensile spring 20 is positioned between the tip 12 and the rod 15. This spring ensures the retention of the rod in its deployed position (FIG. 2*b*) pressing against the rear edge of the tip 12. Any displacement of the rod 15 after its deployment is thereby avoided, even if the axial acceleration is reduced.

The tip 12 and rod 15 constitute a telescopic firing pin that is intended to ignite the pyrotechnic composition 8.

The device 4 further comprises a hammer 21 that may strike the rod 15 when the ammunition impacts on a target to cause the ignition of the composition 8.

According to a first embodiment described with reference to FIGS. 2*a* to 2*c*, the hammer 21 is constituted by a counterweight made integral with the rear part lib of the body by a shearable ring 22.

The device functions as follows.

The front (AV) and rear (AR) of the ammunition are referenced AV and AR respectively.

The device 4 is in its safety storage state in the position shown in FIG. 2*a*. We note that in this position of the device, the rod 15 is located fully inside the tip 12. No part of the tip 12 protrudes with respect to the partition 14 towards the hammer 21.

We note that if a violent shock were to cause the ring 22 to shear, the hammer would be stopped by the washer 23. The pyrotechnic composition 8 would not be subjected to any shocks. The safety of the device is thus complete.

By way of a variant, it would be possible for no washer 23 to be provided to ensure the stopping of the hammer. In this case, it is the partition 13 that will ensure the stopping of the hammer. Safety can be ensured by providing a partition 13 of sufficient thickness. There is no ignition of the composition, since, in the starting state, the rod 15 does not protrude with respect to the partition 13.

When the ammunition is fired by a weapon system, the device 4 (FIG. 2*b*) is subjected to axial acceleration forces F as well as to spin Ω which generate a centrifugal inertial force.

The rod 15 slides in this case and is locked in the deployed position (FIG. 2*b*) by the centrifugal locks 16. In this armed configuration, the rod 15 protrudes with respect to the partition 13 and the firing pin 12-15 is thus deployed.

Upon impact on a target (FIG. 2*c*), the hammer 21 is subjected to substantial inertial force G which causes the retention ring 22 (calibrated according to the force in play) to shear.

The hammer 21 then violently impacts the rod 15 which then pushes the tip 12 against the pyrotechnic composition 8 shearing the threading 14.

Naturally, it would be possible for other shearable means to be provided than the threading 14, for example a circular incipient fracture on the partition 13.

The pyrotechnic composition 8 is ignited by the shock and the explosive load 3 is detonated.

All the mechanical elements described here have symmetry of revolution around the axis 38 of the device (except for locks 16 and their housings). It would naturally be possible for elements to be made of a plane structure, as will be described later.

We can see that, thanks to the invention, the percussion function (ensured by the percussion tip 12, directly in contact with the pyrotechnic composition 8 and incorporating a sliding rod 15) is completely disassociated from the energy supply function for this percussion (which is ensured by the counterweight 21), the counterweight being entirely separate from the tip 12 and its rod 5.

The masses of the tip 12 and its rod 5 are thus of no importance and may be strongly reduced. The percussion energy will be given by the counterweight 21 which may be of any shape and may be in particular adapted to the housings available in the ammunition.

Since the percussion energy is proportional to the mass of the counterweight 21 and to the distance travelled by the counterweight before impacting the rod 5, we see that if the mass of the counterweight is great enough, it is possible to greatly reduce the distance over which the latter must travel. The percussion device according to the invention may thus be very compact (the axial volume of the device may thus easily be reduced by one third).

Figure 3A:
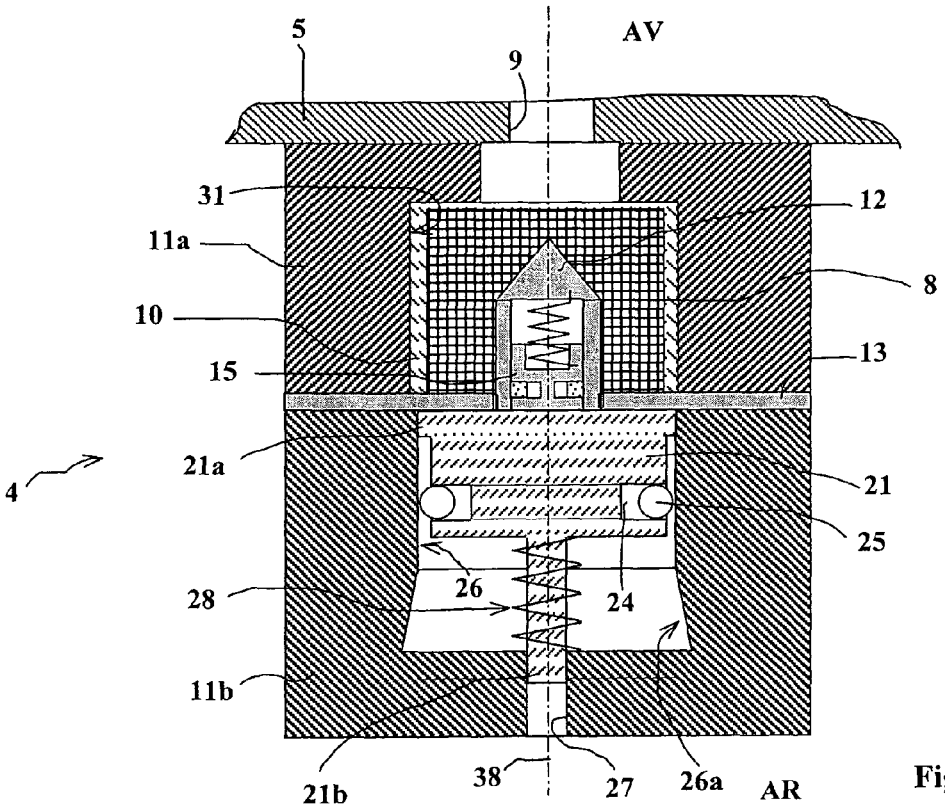
FIGS. 3*a*, 3*b* and 3*c* are schematic section views of a second embodiment of the device according to the invention, FIG. 3*a* showing the device in its storage position, FIG. 3*b* in its armed position after firing and FIG. 3*c* in its percussion position.
Figure 3B:
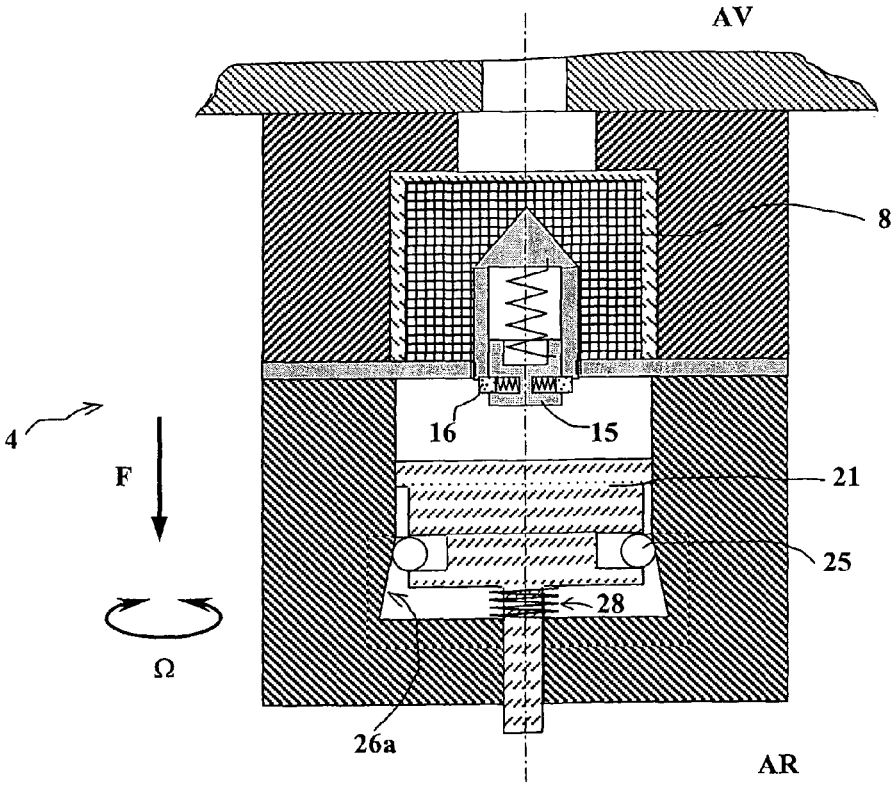
Figure 3C:
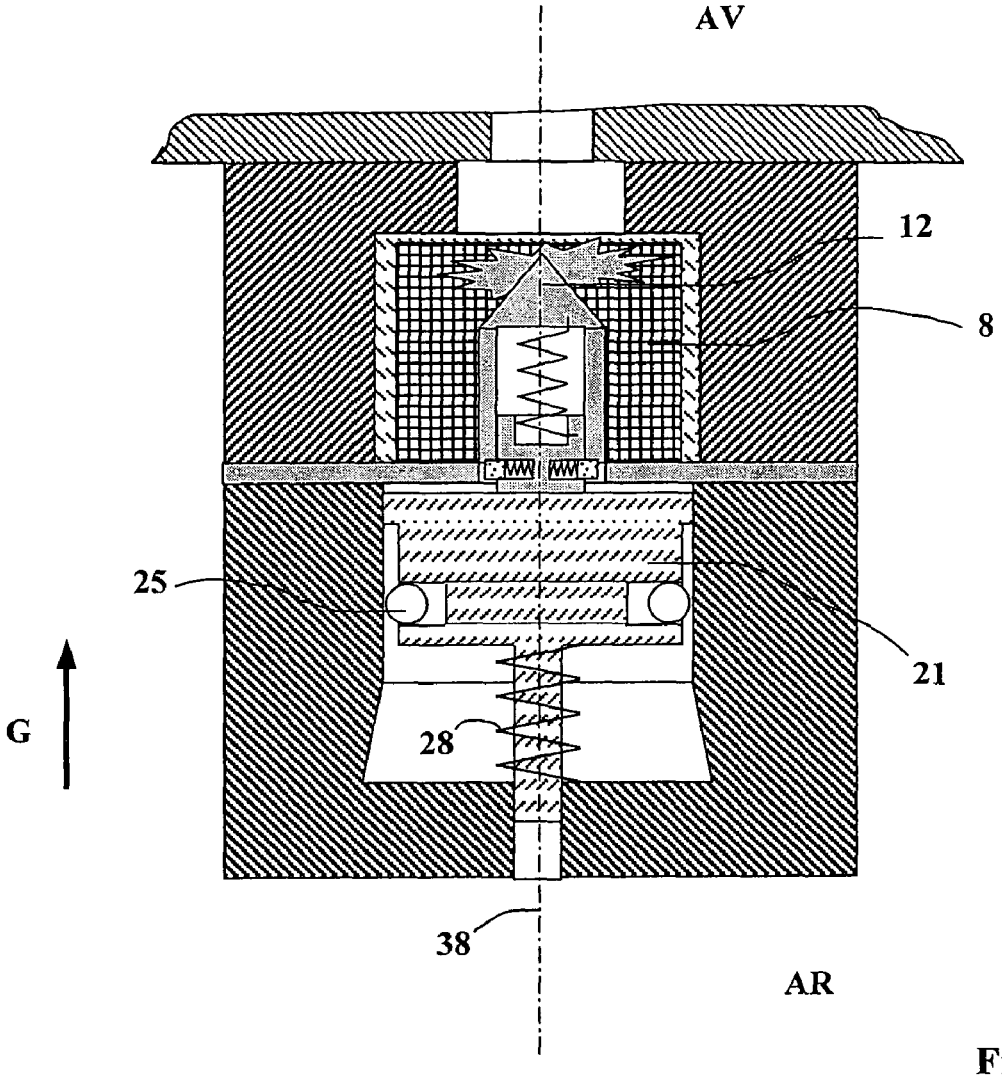

FIGS. 3*a*, 3*b* and 3*c* describe a second embodiment that does not differ from the previous one except in the structure of the hammer 21 that is implemented.

According to this embodiment, the hammer 21 incorporates radial drill holes 24 in which balls 25 are positioned. The hammer 21 is guided in its housing 26 by a front seat 21*a*. This guidance is completed by the sliding of a rear extension 21*b* of lesser diameter in a hole 27 in the rear part 11*b* of the device body.

A compression spring 28 is mounted around the rear extension 21*b*. This spring is positioned between the bottom of the housing 26 and the hammer 21.

The Figures also show that the rear part of the housing 26 has a conical profile 26*a* whose tapering is oriented with the summit of the cone pointing to the fore AV of the ammunition. The axial acceleration F of the projectile during firing causes the hammer 21 to recoil and the spring 28 to be compressed. The balls 25 are radially distanced through the action of the centrifugal inertial force. These balls thus cooperate with the conical profile 26*a* thereby ensuring that the hammer 21 is locked in the armed position shown in FIG. 3*b*.

In fact, classically and as implemented in projectile fuses, the axial acceleration F reduces after the projectile exits the gun barrel whereas the spin continues. The balls 25 applied to the conical profile 26*a* ensure the hammer 21 is locked in the armed position with the spring 28 compressed.

Such an embodiment ensures the self-destruct function of the ammunition. In fact, during impact upon a target, the shock is enough to cause the hammer 21 to be projected on the rod 15 (FIG. 3*c*). When the ammunition does not impact on the target but is stopped (by falling on the ground, for example), the cessation of the spin puts an end to the centrifugal force that was previously applying the balls 25 on the profile 26*a*. The spring 28 thus decompresses projecting the hammer 21 on the rod 15 thereby ensuring the ignition of the composition 8.

Different variants are possible without departing from the scope of the invention. It is namely possible for centrifugal locks to be defined that are of a structure different from that of the balls 25.

The invention may advantageously be implemented to produce a miniaturized firing device in the form of plane elements micro-machined or micro-engraved on a substrate.

Figure 4A:
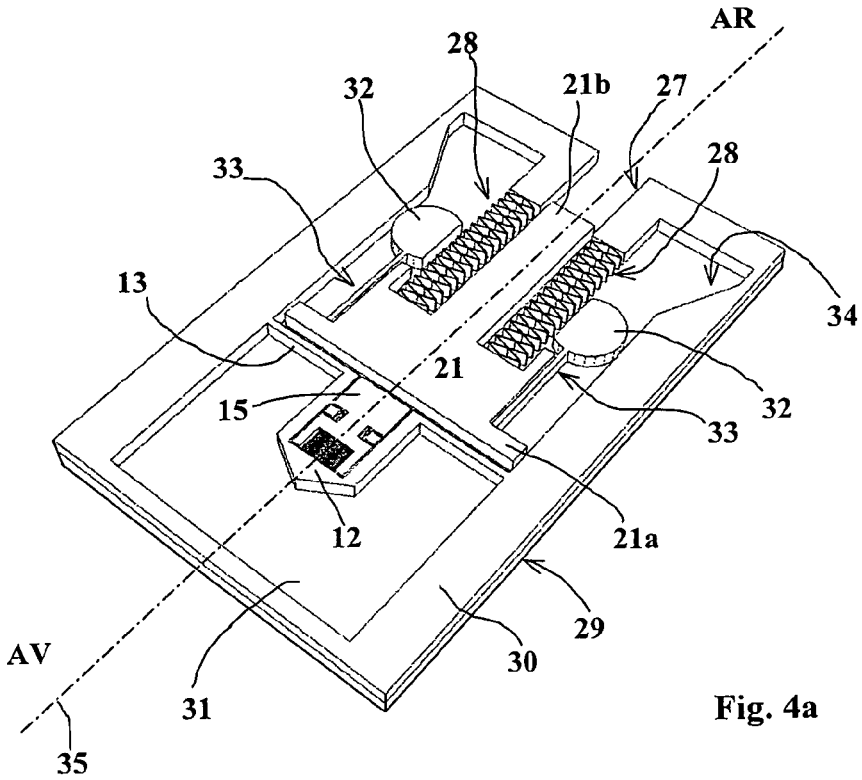
FIGS. 4*a* and 4*b* are schematic section views of a third embodiment of the device according to the invention (embodiment using MEMS), FIG. 4*a* showing the device in its storage position and FIG. 4*b* in its armed position after firing.
Figure 4B:
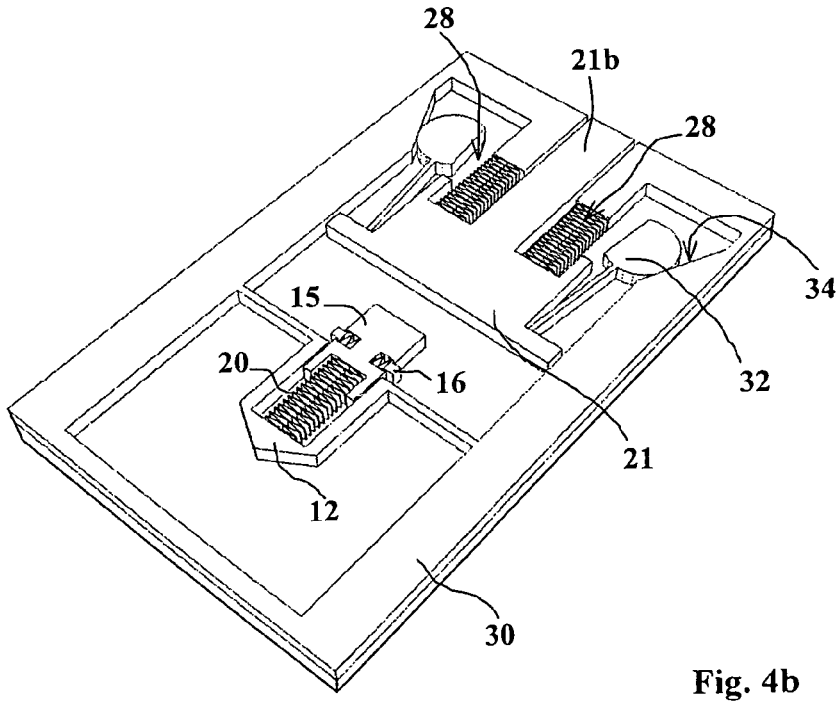
Figure 5:
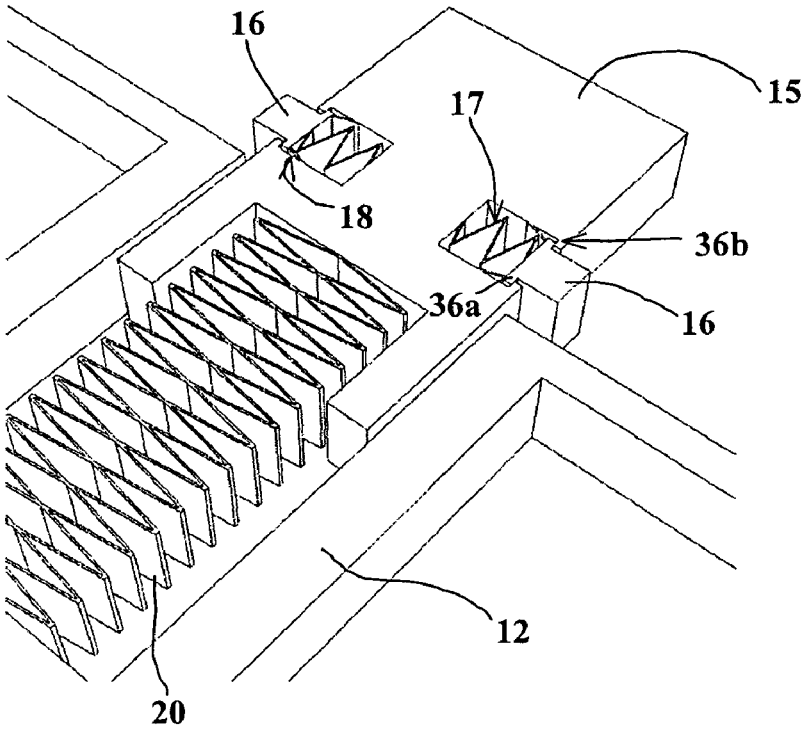
FIG. 5 is a detailed view of a centrifugal lock.

FIGS. 4*a*, 4*b* and 5 show such an embodiment in which the body is made in the form of a micro-machined or micro-engraved wafer 30 deposited on a substrate 29. Classically, MEMS technology enables mobile mechanical elements to be made that have very reduced dimensions. By way of example, the substrate 29 shown here is rectangular in shape with dimensions of around 8 mm in length and 4 mm in width.

The machining made on the wafer 30 has enabled a rectangular cavity 31 to be produced that is intended to receive the pyrotechnic composition (not shown).

The cavity 31 is delimited on one side by the partition 13 made in a single piece with the wafer 30 and the tip 12. The partition 13 will be of a thickness that is sufficiently reduced for the partition 13/tip 12 link to be able to fracture upon being impacted by the hammer 21. Incipient fractures may be arranged during engraving between the tip 12 and partition 13.

The hammer 21 is also obtained by engraving. It has two centrifugal counterweights 32 linked to the hammer 21 by flexible strips 33. The hammer is guided in its housing by its front seat 21*a* and its rear seat 21*b* which is in the form of a tab sliding in the hole 27.

Each counterweight 32 incorporates a hemicircular profile intended to cooperate with a ramp 34 integral with the wafer 30. The ramps 34 are oriented so as to be geometrically intersecting in the front direction AV of the ammunition.

We see that two compression springs 28 are fixed between the hammer 21 and the wafer 30. MEMS technology does not enable springs to be made that are kept in the tensed state. The architecture of the device according to the invention enables a spring 28 to be implemented that is in its starting position in the engraved configuration shown in FIG. 4*a* (and which is also the storage configuration).

It is only during firing that the springs 28 will be compressed by the axial acceleration forces (axis 35 represents the firing direction of the ammunition and the letters AV and AR respectively symbolize the front and rear of the ammunition).

The rod 15 is also produced by engraving and is linked to the tip 12 by a spring 20 also obtained by engraving. FIG. 5 shows this assembly is greater detail. The rod 15 carries two centrifugal locks 16 that are linked by engraved springs 17.

Engraving technology enables springs 17 to be produced that are integral with the rod 15 as well as with the locks 16, their wings 36*a* cooperating with limit stops 36*b* and locking tabs 18 (locking means analogous to those described with reference to FIG. 2*d*).

The springs 17 are obtained in their starting condition. They are stretched during the deployment of the locks 16 through the action of the centrifugal forces. The spring 20 is integral with the rod 15 and tip 12. This spring is in its starting position. It is stretched during firing by the action of the axial acceleration forces.

Naturally, all the mobile elements (hammer 21, counterweights 32, springs 28, 20, 17, rod 15) have been made such that they do not adhere to the substrate 29. The same applies to the tip 12 which must be able to be pushed by the rod 15. Said wafer 30 thus does not adhere to the substrate 29 except by its rectangular periphery and possibly also by part of the partition 13.

Figure 6:
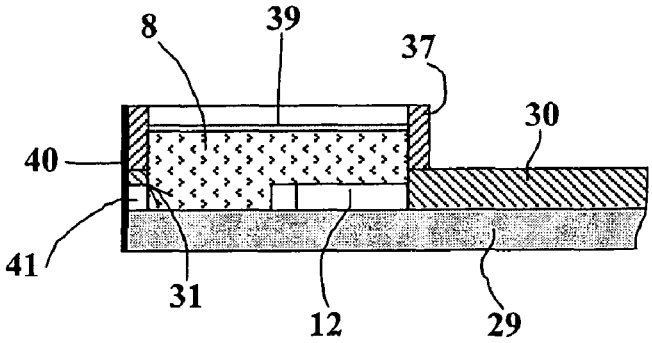
FIG. 6 is a partial section view of the micro-machined wafer.

FIG. 6 shows a partial section of the device at its cavity 31. The Figure shows that a bushing 37 has been placed above the cavity enabling a mass of pyrotechnic composition 8 to be put in place that is greater than what could be contained by the cavity 31 alone.

The composition is put in place under the form, for example, of a drop of pyrotechnic composition enclosing a primary explosive associated with a polymerisable binder and covers the tips 12. A process to put such a composition in place is disclosed, for example, by patent EP1101076.

The friction caused by the displacement of the tip 12 is enough to cause the ignition of all the composition 8. A sealing fail ensures the closing of the bushing 37. Another sealing fail 40 enables the sealing of an opening 41 linking the composition 8 to the pyrotechnic train of the ammunition (not shown).

The functioning of this embodiment is identical to that described previously with reference to FIGS. 3*a* to 3*c*.

The firing acceleration both causes the hammer 21 to recoil and the rod 15 to exit its housing in the tip 12. These movements result in the compression of springs 28 and the stretching of spring 20. The centrifugal force further results in the locks 16 being made to exit their housings thereby blocking the rod 15 in the deployed position.

This centrifugal force also distances the counterweights 32 which are applied to the ramps 34 to ensure the retention of the hammer 21 in the armed position against the action of springs 28.

Upon impacting on a target, the hammer 21 will be projected against the rod 15 which will push the tip 12 onto the pyrotechnic composition. If the spin stops it is springs 28 which will push the hammer 21 thereby triggering self destruction.

What is claimed is:

1. An ammunition firing device incorporating a firing pin intended to impact a pyrotechnic composition to activate its ignition, wherein said firing pin incorporates a rod that slides when said ammunition is fired through the effect of the firing acceleration from a starting position to a deployed position, able to be locked in said deployed position, said rod being integral with a percussion tip occupying a fixed position in contact with said pyrotechnic composition in the starting position, said rod being linked with said tip, said rod being located fully inside said tip in said starting position and protruding from said tip in its deployed position, said device further incorporating a hammer to strike said rod during the impact of said ammunition on a target to cause the ignition of said composition.

2. An ammunition firing device according to claim 1, wherein said sliding rod is locked in its deployed position by at least one centrifugal lock.

3. An ammunition firing device according to claim 1, wherein said sliding rod is linked to said tip by a tensile spring.

4. An ammunition firing device according to claim 3, wherein said percussion tip is integral with a partition that delimits a cavity receiving said pyrotechnic composition, embrittlement means being provided to separate said tip from said partition during the impact of said hammer.

5. An ammunition firing device according to claim 4, wherein said hammer is in said starting position in the vicinity of said rod which is undeployed before firing, a spring means being in its uncompressed state and the firing acceleration causes the displacement of said hammer and the compression of said spring means.

6. An ammunition firing device according to claim 5, wherein said hammer is held away from said firing pin by retention means comprising at least one centrifugal counterweight cooperating with a fixed ramp.

7. An ammunition firing device according to claim 6, wherein said device incorporates a bushing enabling said pyrotechnic composition to be put into place on top of said tip.

8. An ammunition firing device according to claim 4, wherein said device may be made in the form of plane elements micro-machined or micro-engraved onto a wafer.

9. An ammunition firing device according to claim 1, wherein said percussion tip is integral with a partition that delimits a cavity receiving said pyrotechnic composition, embrittlement means being provided to separate said tip from said partition during the impact of said hammer.

10. An ammunition firing device according to claim 1, wherein said hammer is projected against said extendable rod by spring means.

11. An ammunition firing device according to claim 1, wherein said device may be made in the form of plane elements micro-machined or micro-engraved onto a wafer.

12. An ammunition firing device including a firing pin intended to impact a pyrotechnic composition to ignite the pyrotechnic composition upon impact on a target, the ammunition firing device comprising:

a rod being capable of sliding between a starting position and a deployed position due to firing acceleration and capable of locking in the deployed position;

a percussion tip defining a cavity, the percussion tip being integral with the rod and being disposed within the pyrotechnic composition, the percussion tip being in contact with the pyrotechnic composition in the starting position, and the rod being linked with the percussion tip; and a hammer being spaced apart from the rod, the hammer being capable of striking the rod during the impact on the target to cause the ignition of the pyrotechnic composition, wherein the rod is disposed completely inside the cavity of the percussion tip in the starting position and protrudes from the cavity of the percussion tip in the deployed position.

* * * * *